US010109919B2

(12) United States Patent
Guo et al.

(10) Patent No.: US 10,109,919 B2
(45) Date of Patent: Oct. 23, 2018

(54) ANTENNA STRUCTURE

(71) Applicant: INPAQ TECHNOLOGY CO., LTD., Miaoli County (TW)

(72) Inventors: Min-Sen Guo, Taoyuan County (TW); Ding-Bing Lin, New Taipei (TW); Jui-Hung Chou, Taipei (TW); Chih-Ming Su, Taipei (TW); En-Tso Yu, Taichung (TW); Ci-Jie Huang, Hsinchu (TW)

(73) Assignee: INPAQ TECHNOLOGY CO., LTD., Miaoli County (TW)

( * ) Notice: Subject to any disclaimer, the term of this patent is extended or adjusted under 35 U.S.C. 154(b) by 58 days.

(21) Appl. No.: 14/852,683

(22) Filed: Sep. 14, 2015

(65) Prior Publication Data

US 2016/0079669 A1 Mar. 17, 2016

(30) Foreign Application Priority Data

Sep. 15, 2014 (TW) ..... 103131758 A

(51) Int. Cl.

| | |
|---|---|
| ***H01Q 7/00*** | (2006.01) |
| ***H01Q 1/24*** | (2006.01) |
| ***H01Q 1/48*** | (2006.01) |
| ***H01Q 7/04*** | (2006.01) |
| ***H01Q 1/38*** | (2006.01) |

(52) U.S. Cl.

CPC ..... *H01Q 7/00* (2013.01); *H01Q 1/243* (2013.01); *H01Q 1/38* (2013.01); *H01Q 1/48* (2013.01); *H01Q 7/04* (2013.01)

(58) Field of Classification Search

CPC ..... H01Q 7/00; H01Q 1/38; H01Q 1/243; H01Q 1/52

USPC ..... 343/866, 895, 842, 728

See application file for complete search history.

(56) References Cited

U.S. PATENT DOCUMENTS

| | | | | |
|---|---|---|---|---|
| 2008/0129637 | A1* | 6/2008 | Chi | H01Q 1/38 343/866 |
| 2009/0295664 | A1* | 12/2009 | Kubo | H01Q 1/38 343/788 |
| 2014/0218261 | A1* | 8/2014 | Ito | H01Q 7/06 343/866 |

* cited by examiner

*Primary Examiner* — Dameon E Levi
*Assistant Examiner* — Collin Dawkins
(74) *Attorney, Agent, or Firm* — Li & Cai Intellectual Property (USA) Office

(57) ABSTRACT

An antenna structure includes a board unit and a coil unit. The board unit includes a metal board and an insulating board connected with or adjacent to the metal board, and the coil unit is disposed beside the same side of the metal board and the insulating board. In one embodiment, when one narrow side of the metal board and one narrow side of the insulating board connects with each other, the coil unit is disposed right under the commissure of the metal board and the insulating board. In addition, more than half or half of the area of the coil unit is covered by the insulating board, and less than half or half of the area of the coil unit is covered by the metal board. The current direction on the metal board and the current direction on the coil unit are the same as clockwise or counterclockwise.

6 Claims, 7 Drawing Sheets

ANTENNA STRUCTURE

BACKGROUND

1. Technical Field

The present disclosure relates to an antenna structure, in particular, to an antenna structure for telecommunication devices.

2. Description of Related Art

Mobile phones or any type of telecommunication devices have become part of the personal belongings of people in modern society. The main function of the telecommunication device used to be dialing, texting or wireless internet surfing. However, with the advance of science and technology, due to the portable characteristic of mobile phones, developers have tended to integrate the functions associated with daily life into mobile phones, such as the function of contactless smart cards. Contactless smart cards utilize close range sensitivity to employ the function of the chip in the card. Currently, the contactless smart cards are widely used in daily life, such as contactless credit cards in PayPass™ and VISA WAVE format, Easy Card for public transportation, i-cash of 7-11, access card or membership card with ID identification function, etc. The smart cards above provide convenient service for the user in daily life, and hence, developers tend to integrate the function of the smart card into mobile phones which carried by people in daily life, to transform the mobile phones which were used to telecommunicate into mobile phones which may be used as a credit card, e-wallet, public transportation tickets or identity identification devices. The mobile phones with the above function typically have a near field communication antenna (NFC antenna) positioned therein, and most of the communication antennas are positioned on the mother board of a mobile phone.

SUMMARY

The embodiment of the instant disclosure provides an antenna structure, the antenna structure may be used as a near field communication antenna of a telecommunication device.

An antenna structure provided by one embodiment of the instant disclosure comprises a board unit and a coil unit. The board unit comprises a metal board and an insulating board connected with or adjacent to the metal board, and the coil unit is disposed beside a same side of the metal board and the insulating board.

Preferably, when a narrow side of the metal board and a narrow side of the insulating board are connected with each other, the coil unit is disposed right under the commissure of the metal board and the insulating board.

Preferably, when a narrow side of the metal board and a narrow side of the insulating board is adjacent, the coil unit is disposed right under a position between the metal board and the insulating board.

Preferably, more than half or half of the area of the coil unit is covered by the insulating board, and less than half or half of the area of the coil unit is covered by the metal board.

Preferably, a current direction on the metal board and a current direction on the coil unit are the same as clockwise or counterclockwise.

The antenna structure provided by another embodiment of the instant disclosure comprises a board unit and a coil unit. The board unit comprises a metal board and an insulating portion penetrating the metal board, and the coil unit is disposed beside a same side of the metal board and the insulating portion.

Preferably, the insulating portion is an insulating filler or an air layer.

Preferably, the coil unit is disposed right under the commissure of the metal board and the insulating portion.

Preferably, more than half or half of the area of the coil unit is covered by the insulating portion, and less than half or half of the area of the coil unit is covered by the metal board.

Preferably, a current direction on the metal board and a current direction on the coil unit are the same as clockwise or counterclockwise.

The advantage of the instant disclosure resides in that according to the design of "the board unit comprises a metal board and an insulating board connected with or adjacent to the metal board, and the coil unit is disposed beside a same side of the metal board and the insulating board" and "the board unit comprises a metal board and an insulating portion penetrating the metal board, and the coil unit is disposed beside a same side of the metal board and the insulating portion", the antenna structure provided by the instant disclosure may form a near field communication antenna for telecommunication devices.

In order to further understand the techniques, means and effects of the instant disclosure, the following detailed descriptions and appended drawings are hereby referred to such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1:
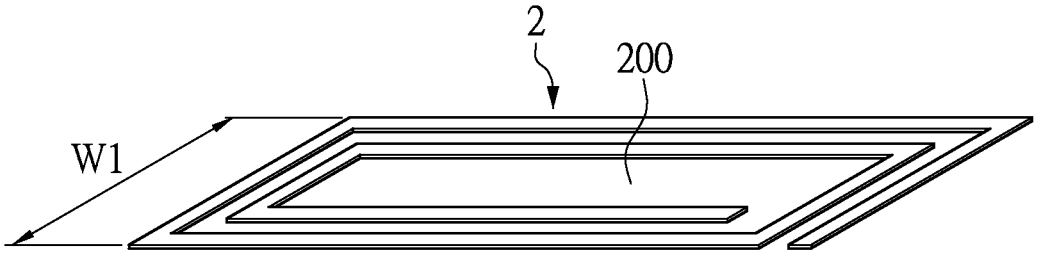
FIG. 1 is a three-dimensional schematic view of the coil unit of the first embodiment of the instant disclosure.

Reference will now be made in detail to the exemplary embodiments of the antenna structure of the instant disclosure, examples of which are illustrated in the accompanying drawings. Wherever possible, the same reference numbers are used in the drawings and the description to refer to the same or like parts.

First Embodiment

Figure 2:
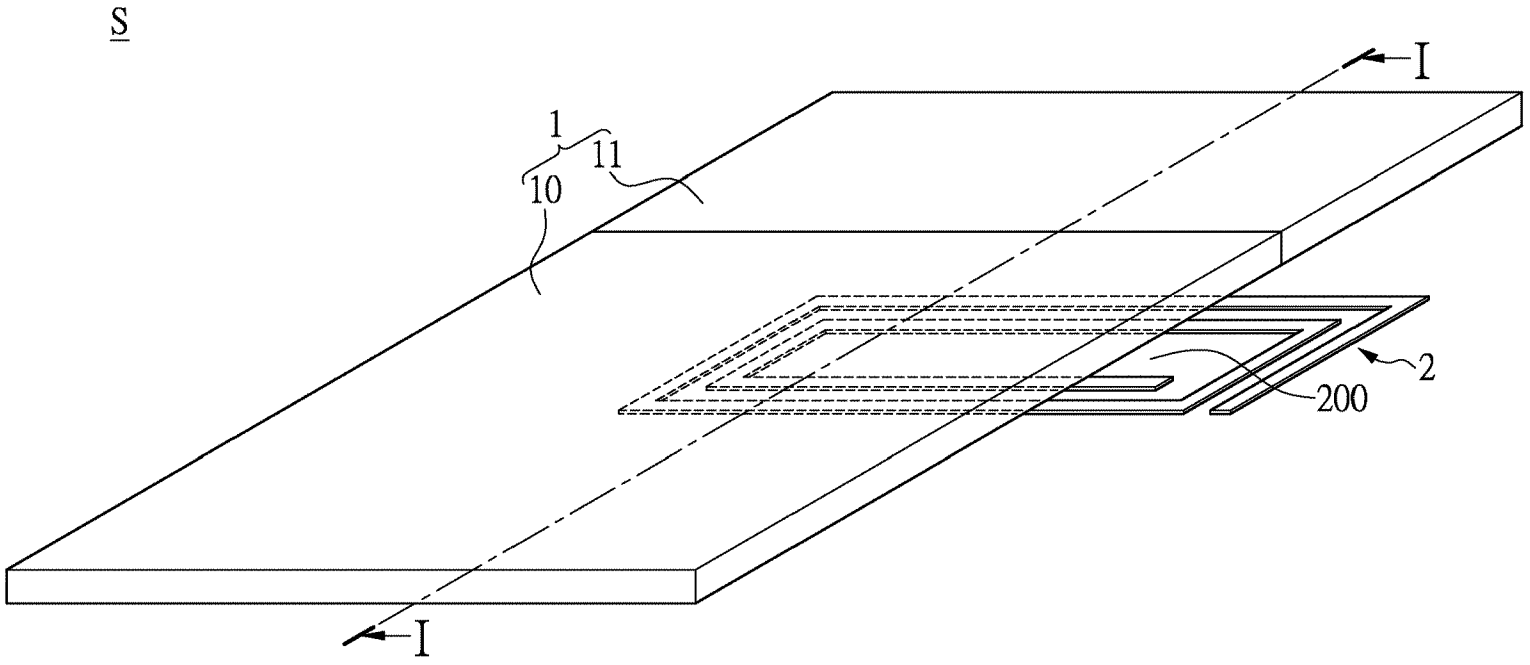
FIG. 2 is a three-dimensional schematic view of the antenna structure of the first embodiment of the instant disclosure.
Figure 3:
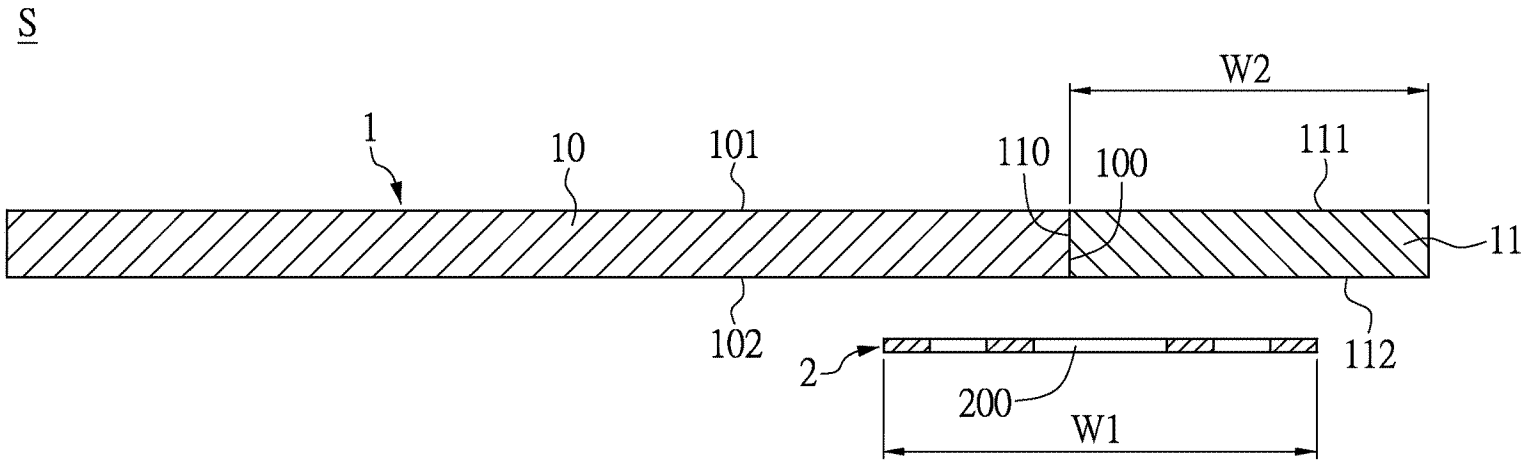
FIG. 3 is a cross-sectional view taken along cutting line I-I of FIG. 2.
Figure 4:
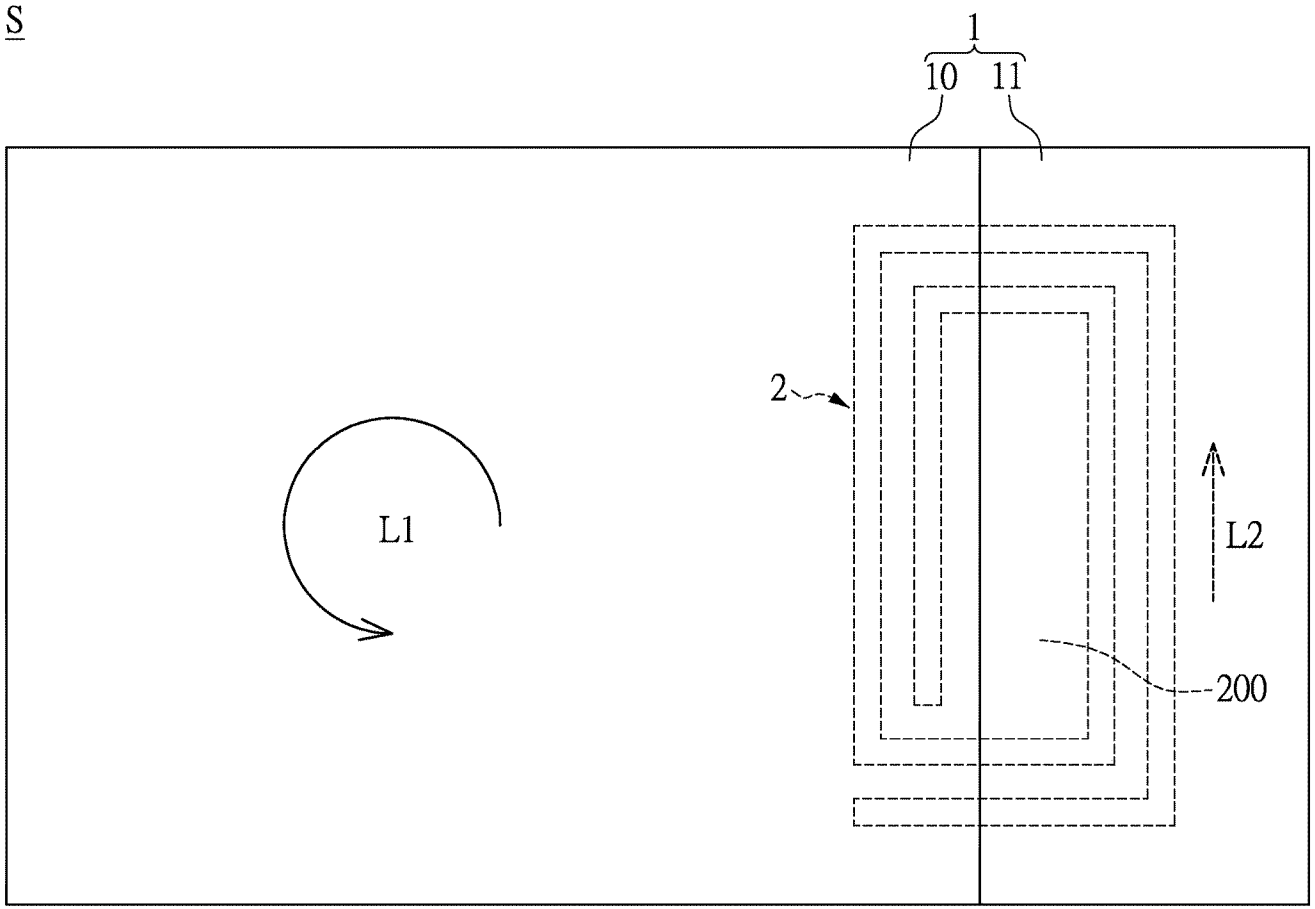
FIG. 4 is a top view of the antenna structure of the first embodiment of the instant disclosure.

Please refer to FIGS. 1 to 4. FIG. 1 is a three-dimensional schematic view of the coil unit 1, FIG. 2 is a three-dimensional schematic view of the antenna structure S, FIG. 3 is a cross-sectional view taken along cutting line I-I of FIG. 2, and FIG. 4 is a top view of the antenna structure S. As shown in the figures, the first embodiment of the instant disclosure provides an antenna structure S comprising: a board unit 1 and a coil unit 2, wherein the antenna structure S may be a near field communication (NFC) antenna for telecommunication devices such as mobile phones.

First, please refer to FIGS. 2 and 3. The board unit 1 comprises a metal plate 10 and an insulating board 11 connected to the metal board 10, wherein the metal board 10 may be made from any type of metal material, and the insulating board 11 may be made from any type of insulating material. Furthermore, as shown in FIG. 3, one narrow side 100 of the metal board 10 may connect to one narrow side 110 of the insulating board 11, however, the connection manner is not limited. It is worthwhile to mention that the metal board 10 and the insulating board 11 are not limited to be connected with each other. In another embodiment, the insulating board 11 may be adjacent or very close to the metal plate 10.

Furthermore, refer to FIG. 1, FIG. 3 and FIG. 4. The coil unit 2 is disposed beside a same side of the metal board 10 and the insulating board 11. As shown in FIG. 4, the current direction L1 on the metal board 10 and the current direction L2 on the coil unit 2 are the same as clockwise or counterclockwise. For instance, as shown in FIG. 1, the coil unit 2 may formed by rolling the coil in rectangular shape. The coil unit 2 may also be formed by rolling the coil in a circular or square shape. Furthermore, referring to FIGS. 3 and 4, in a preferable embodiment, when a narrow side 100 of the metal board 10 and a narrow side 110 of the insulating board 11 are connected with each other, the coil unit 2 is disposed right under the commissure of the metal board 10 and the insulating board 11. Particularly, the coil opening 200 formed by the coil unit 2 is disposed right under the commissure of the metal board 10 and the insulating board 11. However, the instant disclosure is not limited to the above examples. In addition, in a preferable embodiment, when one narrow side 100 of the metal board 10 and one narrow side 110 of the insulating board 11 are adjacent or very close with each other, the coil unit 2 is disposed right under a position between the metal board 10 and the insulating board 11. Particularly, the coil opening 200 formed by the coil unit 2 is disposed right under a position between the metal board 10 and the insulating board 11. However, the instant disclosure is not limited to the above examples.

As shown in FIG. 3, it is worthwhile to mention that the metal board 10 and the insulating board 11 both have an upper surface (101, 111) and a lower surface (102, 112) with respect to the upper surface (101, 111). The coil unit 2 is disposed below the lower surface (102, 112) of the metal board 10 and the insulating board 11. In addition, the coil unit 2 may adhere to the lower surface (102, 112) of the metal board 10 or the insulating board 11 by any insulating manner (such as through insulating tapes). Alternatively, the coil unit 2 may be supported by any supporting member rather than adhere to the lower surface (102, 112) of the metal board 10 or the insulating board 11 in an insulated manner.

Refer to FIG. 2 and FIG. 3. It is worthwhile to mention that, assuming that the distance from the center of the coil unit 2 to the outmost part of the coil unit 2 is "half width W1 of the coil unit 2", in a preferable embodiment, the width W2 of the insulating board 11 must be larger than or equal to the half width W1 of the coil unit 2. Larger than or equal to half width W1 of the coil unit 2 must be disposed in the covering region of the insulating board 11, therefore, half width W1 of the coil unit 2 or more than half width W1 of the coil unit 2 is disposed right under the insulating board 11 and covered by the insulating board 11. That is to say, less than half width W1 or half width W1 of the coil unit 2 must be covered by the covering region of the metal board 10, and hence, less than half width W1 or half width W1 of the coil unit 2 is disposed right under the metal board 10 and covered by the metal board 10. In other words, in a preferable embodiment of the instant disclosure, more than half or half of the area of the coil unit 2 is covered by the insulating board 11, and less than half or half of the area of the coil unit 2 is covered by the metal board 10. According to the simulating experiments, when more than half or half of the area of the coil unit 2 is covered by the insulating board 11, and less than half or half of the coil unit 2 is covered by the metal board 10, the antenna structure S of the instant disclosure may provide the best magnetic field distribution.

Second Embodiment

Figure 5:
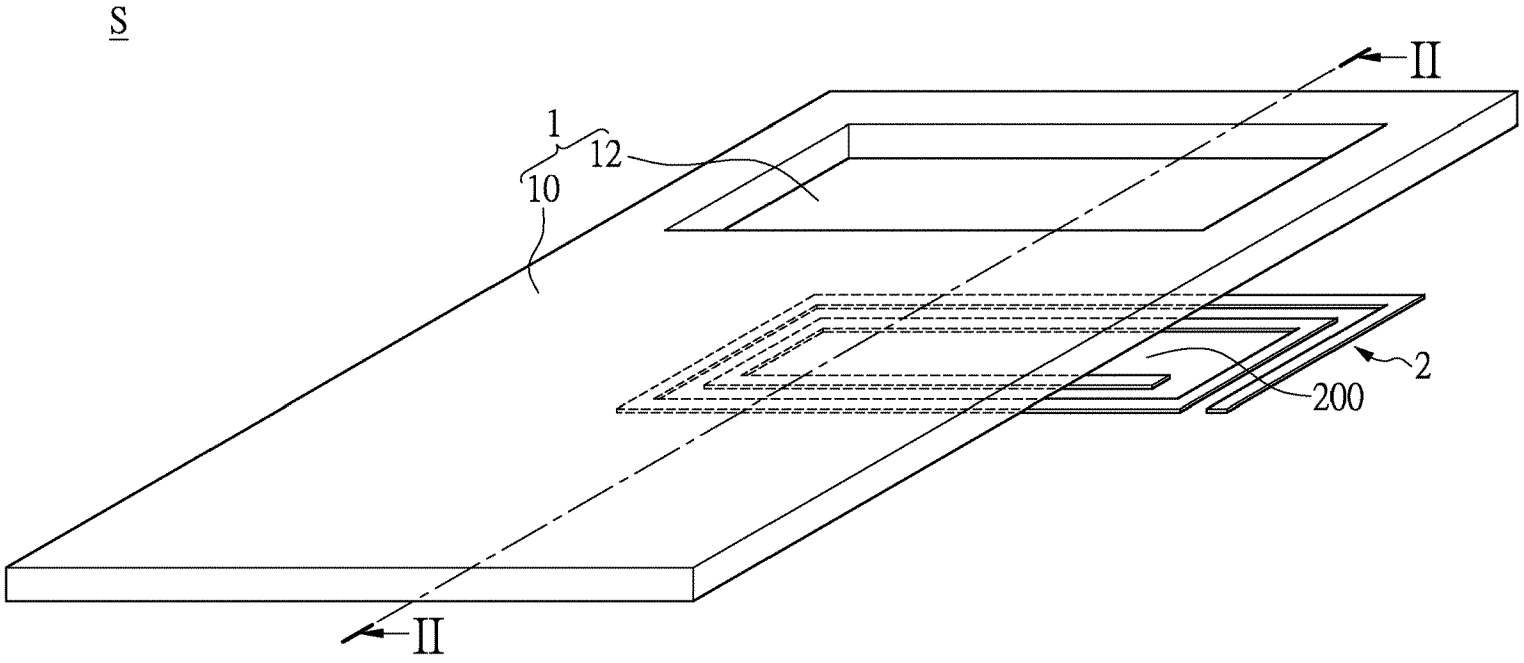
FIG. 5 is a three-dimensional schematic view of the antenna structure of the second embodiment of the instant disclosure.
Figure 6:
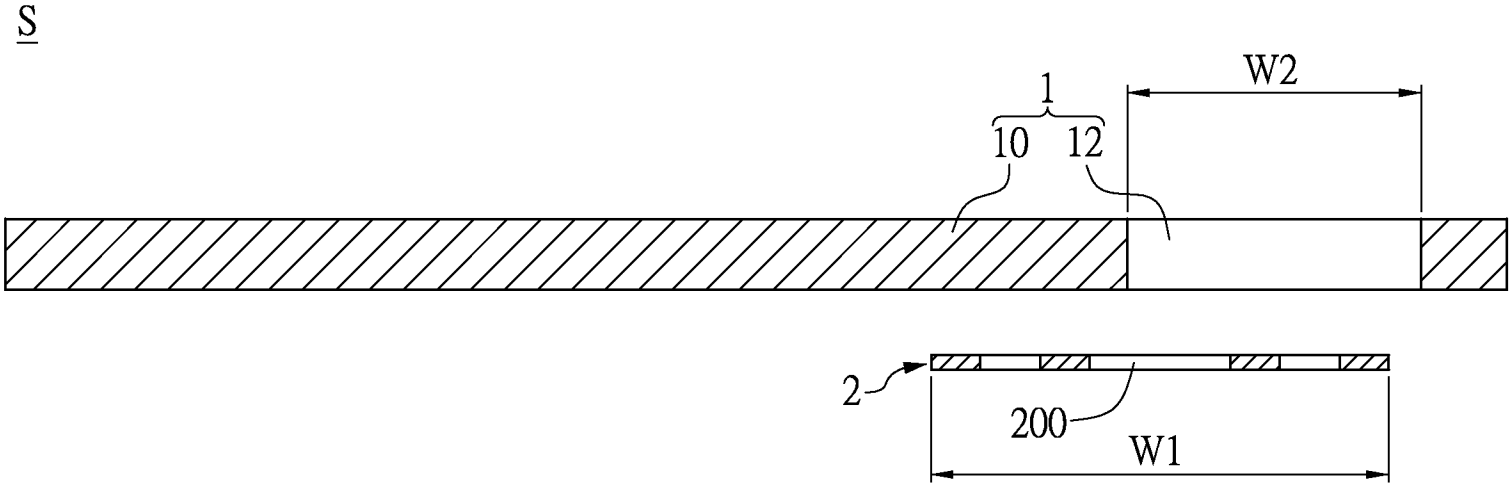
FIG. 6 is a cross-sectional view taken along cutting line II-II of FIG. 5.
Figure 7:
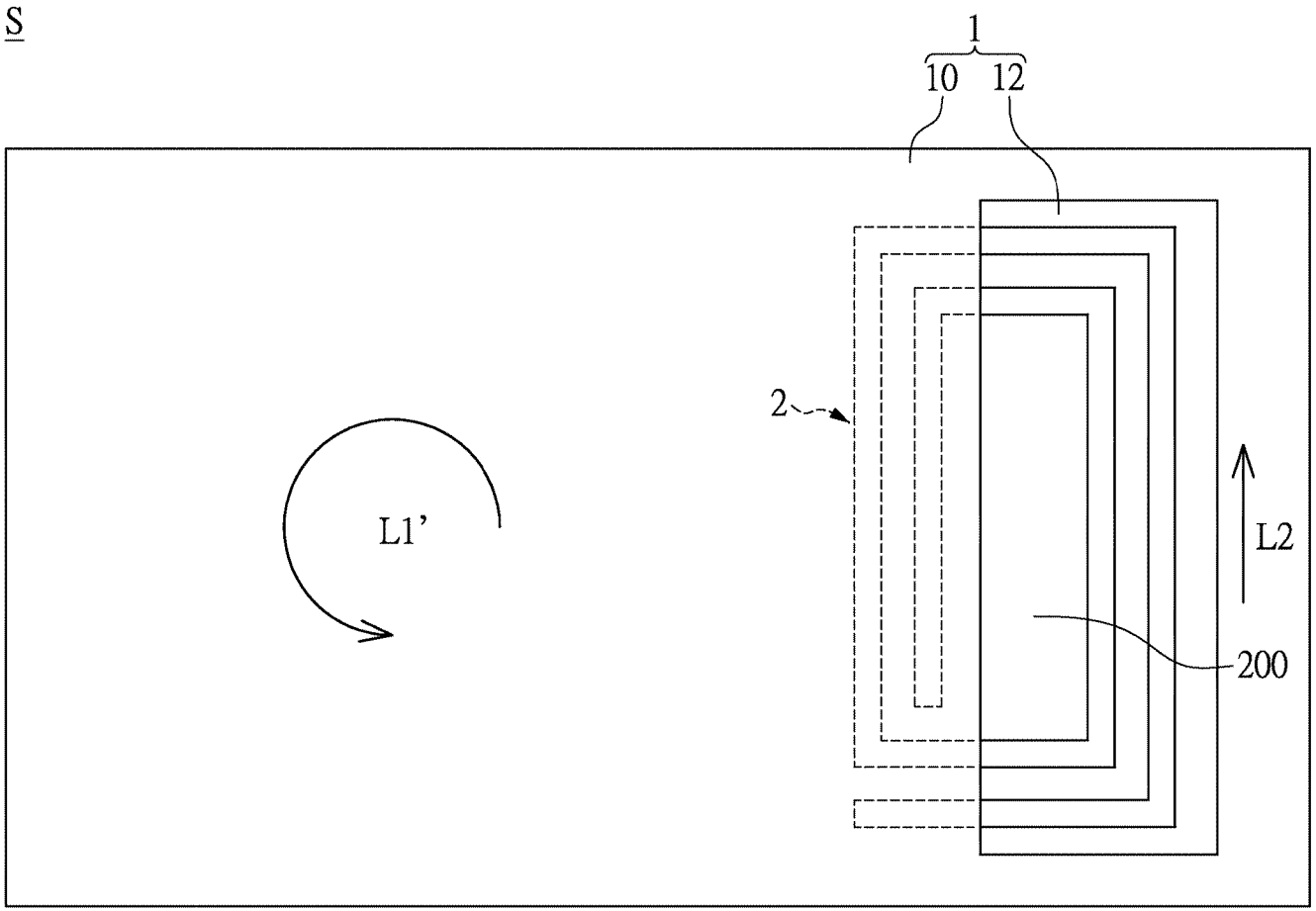
FIG. 7 is a top view of the antenna structure of the second embodiment of the instant disclosure.

Please refer to FIG. 5 to FIG. 7. FIG. 5 is a three-dimensional schematic view of an antenna structure, FIG. 6 is a sectional view of FIG. 5 along the II-II cutting line, and FIG. 7 is a top view of the antenna structure. As shown in the figures, the second embodiment provides an antenna structure S comprising: a board unit 1 and a coil unit 2, wherein the antenna structure S is a near field communication (NFC) antenna for a telecommunication device (such as a mobile phone).

First, please refer to FIG. 5 and FIG. 6, the board unit 1 comprises a metal board 10 and an insulating portion 12 penetrating the metal board 10, wherein the metal board 10 may be made from any type of metal material, and the insulating portion 12 may be one of an insulating filler or an air layer. In the second embodiment, the insulating portion 12 is an air layer, but the instant disclosure is not limited thereto.

Furthermore, refer to FIG. 5, FIG. 6 and FIG. 7. The coil unit 2 is disposed beside a same side of the metal board 10 and the insulating portion 12. As shown in FIG. 7, the partial current direction L1' on the metal board 10 and the current direction L2 on the coil unit 2 are the same as clockwise or counterclockwise. Furthermore, referring to FIG. 6 and FIG. 7, the coil unit 2 may be disposed right under the commissure of the metal board 10 and the insulating portion 12, particularly, the coil opening 200 formed by the coil unit 2 is disposed right under the commissure of the metal board 10 and the insulating portion 12, but the instant disclosure is not limited thereto.

Refer to FIG. 6. It is worthwhile to mention that same as the first embodiment, the coil unit 2 may be arranged under the lower surface (not symbolized) of the metal board 10 and the insulating portion 12. Furthermore, the coil unit 2 may adhere to the lower surface (not symbolized) of the metal board 10 or the insulating portion 12 by any insulating manner. Alternatively, the coil unit 2 may be supported by any supporting member, rather than adhere to the lower surface (102, 112) of the metal board 10 or the insulating portion 12 in an insulated manner.

Refer to FIG. 6 and FIG. 7. Assuming that the distance from the center to the outmost part of the coil unit 2 is "half width W1 of the coil unit 2", in a preferable embodiment, the width W2 of the insulating portion 12 must be larger than or equal to the half width W2 of the coil unit 2. Larger than or equal to half width W1 of the coil unit 2 must be disposed in the covering region of the insulating portion 12, therefore, half width W1 of the coil unit 2 or more than half width W1 of the coil unit 2 is disposed right under the insulating portion 12 and covered by the insulating portion 12. That is to say, less than half width W1 or half width W1 of the coil unit 2 must be covered by the covering region of the metal board 10, and hence, less than half width W1 or half width W1 of the coil unit 2 is disposed right under the metal board 10 and covered by the metal board 10. In other words, in a preferable embodiment of the instant disclosure, more than half or half of the area of the coil unit 2 is covered by the insulating portion 12, and less than half or half of the area of the coil unit 2 is covered by the metal board 10. According to the simulating experiments, when more than half or half of the area of the coil unit 2 is covered by the insulating portion 12, and less than half or half of the coil unit 2 is covered by the metal board 10, the antenna structure S of the instant disclosure may provide best magnetic field distribution.

Possible Effect Achieved by the Embodiments

In summary, the advantages of the instant disclosure reside in that based on the design of "the board unit 1 comprises a metal board 10 and an insulating board 11 connected with or adjacent to the metal board 10, and the coil unit 2 is disposed beside a same side of the metal board 10 and the insulating board 11" and "the board unit comprises a metal board and an insulating portion 12 penetrating the metal board, and the coil unit is disposed beside a same side of the metal board and the insulating portion 12", the antenna structure S provided by the instant disclosure may form a near field communication antenna for telecommunication devices.

The above-mentioned descriptions represent merely the exemplary embodiment of the instant disclosure, without any intention to limit the scope of the instant disclosure thereto. Various equivalent changes, alterations or modifications based on the claims of the instant disclosure are all consequently viewed as being embraced by the scope of the instant disclosure.

What is claimed is:

1. An antenna structure comprising:

a board unit comprising a metal board and an insulating board connected with or adjacent to the metal board; and a coil unit disposed beside a same side of the metal board and the insulating board, wherein the metal board has a plurality of peripheral sides, one of the peripheral sides of the metal board is connected with one of a plurality of peripheral sides of the insulating board, and the other peripheral sides of the metal board are exposed without connecting with the other peripheral sides of the insulating board, wherein the coil unit is disposed right across both of the metal board and the insulating board and separated from the metal board.

2. The antenna structure according to claim 1, wherein more than half or half of an area of the coil unit is covered by the insulating board, and less than half or half of the area of the coil unit is covered by the metal board.

3. The antenna structure according to claim 1, wherein a current direction on the metal board and a current direction on the coil unit are the same as clockwise or counterclockwise.

4. An antenna structure comprising:

a board unit comprising a metal board and an insulating board connected with or adjacent to the metal board; and a coil unit disposed beside a same side of the metal board and the insulating board, wherein the metal board has a plurality of peripheral sides, one of the peripheral sides of the metal board is connected with one of a plurality of peripheral sides of the insulating board, and the other peripheral sides of the metal board are exposed without connecting with the other peripheral sides of the insulating board, wherein the coil unit is separated from the metal board.

5. The antenna structure according to claim 4, wherein more than half or half of an area of the coil unit is covered by the insulating board, and less than half or half of the area of the coil unit is covered by the metal board.

6. The antenna structure according to claim 4, wherein a current direction on the metal board and a current direction on the coil unit are the same as clockwise or counterclockwise.

* * * * *